US009789507B2

(12) United States Patent
Phillippi

(10) Patent No.: US 9,789,507 B2
(45) Date of Patent: Oct. 17, 2017

(54) SPRAY BOOTH SPRAY RACKS

(71) Applicant: Patrick G. Phillippi, Rolling Meadows, IL (US)

(72) Inventor: Patrick G. Phillippi, Rolling Meadows, IL (US)

( * ) Notice: Subject to any disclaimer, the term of this patent is extended or adjusted under 35 U.S.C. 154(b) by 0 days.

(21) Appl. No.: 15/043,809

(22) Filed: Feb. 15, 2016

(65) Prior Publication Data

US 2017/0232463 A1 Aug. 17, 2017

(51) Int. Cl.

| | |
|---|---|
| ***B23P 11/00*** | (2006.01) |
| ***B05B 15/12*** | (2006.01) |
| ***A47B 81/00*** | (2006.01) |

(52) U.S. Cl.

CPC ..... *B05B 15/1203* (2013.01); *A47B 81/00* (2013.01); *B05B 15/1214* (2013.01)

(58) Field of Classification Search

CPC ..... B23P 11/00; B23P 15/00; B23P 19/00; B23Q 1/00; B23Q 3/00

See application file for complete search history.

(56) References Cited

U.S. PATENT DOCUMENTS

| | | | | |
|---|---|---|---|---|
| 4,524,959 | A * | 6/1985 | Kubo | B23K 37/0533 269/156 |
| 4,863,655 | A | 9/1989 | Lacourse | |
| 4,870,805 | A | 10/1989 | Morane | |
| 5,458,933 | A | 10/1995 | Suskind | |
| 5,540,962 | A | 7/1996 | Suskind | |
| 6,312,823 | B1 | 11/2001 | El-Afandi | |
| 6,391,402 | B1 | 5/2002 | Yokota | |
| 6,409,128 | B1 * | 6/2002 | Deshler | B05B 13/0285 248/125.1 |
| 7,434,302 | B2 * | 10/2008 | Hetschel | B23Q 7/043 29/255 |
| 7,669,306 | B2 * | 3/2010 | Palka | B25B 27/02 29/255 |
| 2009/0139071 | A1 * | 6/2009 | Palka | B25B 27/02 29/259 |
| 2011/0098969 | A1 * | 4/2011 | Knudsen | G01D 1/00 702/150 |

* cited by examiner

*Primary Examiner* — Lee D Wilson

(74) *Attorney, Agent, or Firm* — Charles F. Meroni, Jr.; Meroni & Meroni, PC

(57) ABSTRACT

A paint rack having an attachment support bar, three leg portions, and three grate attachment portions, the three grate attachment portions matably attachable to a floor grate, the three leg portions mounted on top of the three grate attachment portions and extending upwardly from the grate attachment portions, the attachment support bar connected to the three leg portions, and extending upwardly from the three leg portions.

14 Claims, 5 Drawing Sheets

SPRAY BOOTH SPRAY RACKS

BACKGROUND OF THE INVENTION

Field of the Invention

The present invention generally relates to a spray booth, spray rack, and painting assembly and related methods. More particularly, the present invention relates to an adaptable paint rack which can be adjusted to be cooperable with various paint racks, and floor mechanisms.

Discussion of the Prior Art

U.S. Pat. No. 3,858,864 ('864 Patent), which issued to Waldo, discloses a Vehicle Door Supporting Apparatus. The '864 Patent describes a door supporting apparatus for supporting a door of a vehicle in a desired position comprises a movable dolly base. An angular member is rotatably mounted on the base in a manner whereby it is at substantially right angles to the base in one position and substantially parallel to the base in another position.

U.S. Pat. No. 4,530,492 ('492 Patent), which issued to Bork, discloses an Apparatus for Supporting Vehicle Body Parts. The '492 Patent describes an apparatus and method for supporting vehicle body parts to be worked upon, and the method includes the steps of supporting a vehicle body part, such as a car door, on a mobile jack and moving the body part to apparatus which supports the body part after the apparatus is withdrawn. The apparatus includes an enclosure frame which is horizontally disposed and which has two separable sections so that the body part can be placed within the confines of one of the sections, and the other section can then be assembled with the first section for completely supporting the vehicle body part for working thereon.

U.S. Pat. No. 5,296,030 ('030 Patent), which issued to Young, discloses a Painting Rack for Vehicle Parts. The '030 Patent describes a painting rack for the mounting of a variety and multiplicity of vehicle parts, the sections of which are designed for ease in assembly and disassembly for storage and transport. The rack defines a hole portion to which can be inserted a plurality of rod-like supports extending outwardly therefrom which are rotatable in a given plane for spacing and counterbalance of the parts mounted thereon.

U.S. Pat. No. 5,660,637 ('637 Patent), which issued to Dodge, discloses a Paint Rack for a Vehicle Body Shop. The '637 Patent describes a paint rack for use in a vehicle body shop includes a frame mounted on wheels, which are repositionable wheels for use or storage as desired. The frame may be fixed or adjustable, both vertically and horizontally.

U.S. Pat. No. 5,707,450 ('450 Patent), which issued to Thompson, discloses an Apparatus for Holding a Vehicle Body Part. The '450 Patent describes an apparatus for holding a vehicle body part for painting has a support attached to a pivotable arm on a stand. The height of the stand and the position of the pivotable arm is adjustable. The support includes three support arms which can be set in different positions to hold body parts of various shapes and sizes in a convenient position. Cords attached to the pivot arm are used to hold the body parts in position on the support arms.

U.S. Pat. No. 6,025,348 ('348 Patent), which issued to Ventura et al., discloses an Adjustable Clamping Stand for Supporting Automobile Panels. The '348 Patent describes a stand for supporting an automobile body panel having a peripheral edge for inspection and repair comprises two sets of clamping members secured on opposite ends of two clamping assemblies which are pivotally mounted to the top of a vertically oriented telescoping support assembly. Each clamping member include a clamp pad having a groove formed therein and adapted to receive a peripheral edge of the automobile body panel to support the panel during inspection and repair.

U.S. Pat. No. 6,729,632 ('632 Patent), which issued to Ferrigan, discloses a Collapsible Rack for an Automotive Body Panel. The '632 Patent describes a collapsible rack for supporting an automotive body panel, such as a removable automobile hardtop. The collapsible rack supports the panel and becomes more compact for storage. The collapsible rack has a T-shaped member that is removable for placement of the rack in a truck of an automobile, or for stowage in a neck defined by the frame. In a first position, the frame and member hold the hardtop or automotive body panel upright. In a second position, the member is stowed in the frame.

U.S. Pat. No. 6,875,277 ('277 Patent), which issued to Edgerton, discloses a Painting Stand and Method for Painting. The '277 Patent describes a method and apparatus for holding an article to be painted coated with a stand. In one embodiment the stand comprises (a) a first leg, (b) a second leg, (c) an upper connecting member attached to the first and second legs at an upper elevational position, (d) a base connecting the first and second legs at a lower elevational position, (e) at least part of the upper connecting member being insertable in a hardware opening of the article, and (f) the base extending on at least two sides of the article.

U.S. Pat. No. 7,448,606 ('606 Patent), which issued to Johnson, discloses a Large Automotive Panel Paint Truck. The '606 Patent describes a large automotive panel paint rack having a wheel-mounted base with an adjustable upright post and at least one platform having adjustable support members and hook members. It also has heat and paint-resistant protective rubber sleeves to keep critical adjustment threads free from over-spray. The large panel paint rack permits stationary support of a large part, especially a large automotive panel part for preparation work, repair and painting.

U.S. Pat. No. 8,328,173 ('173 Patent), which issued to DesForge, et al, discloses a Support Stand for Automotive Parts. The '173 Patent describes a support stand system for supporting parts of automobiles for repair work or painting purposes featuring a main base and one or more additional components including a fender stand for supporting fenders, a bumper stand for supporting bumpers, a paint tray, a door stand for supporting doors and hoods, and a sawhorse. The components are interchangeable. Securing devices such as clamp brackets can be used with any of the components.

SUMMARY OF THE INVENTION

Painting car, motorcycle, and other automotive parts is a difficult process that poses significant health hazards as well as hazards to the environment. In addition, the process of painting these parts can require a large amount of bulky equipment which needs to be moved and stored wasting valuable floor space for the painter and his workshop. Traditional paint stands typically must be large and heavy because they must be capable of holding and supporting heavy car parts without tipping over during the painting process. These traditional stands are typically difficult to move, or are equipped with wheels which are unreliable, and also can cause issues during the painting process. Thus, the present invention features a lightweight, detachable support stand system capable of mating with a plurality of attachments.

Furthermore, the majority of modern industrial painting utilizes paint shops and booth structures that have been devised to effectively employ various air flow design characteristics, to reduce paint booth operating costs while minimizing environmental contamination. Modern paint booths of this design are known as downdraft paint booths and are equipped with a grate replacing much of the flooring. This grate allows excess aerosolized paint that misses a part to be sucked downwards and filtered, drastically reducing health risks to the employees of the paint shop, and drastically reducing the environmental hazards posed by paint circulating into the air. However, such grates pose significant downsides to the traditional paint stands described above. First, they prevent the wheeled stands from moving effectively traversing the floor of a paint ship, and second they often cause instability of a paint stand. Therefore, a paint stand that is capable of removably securing itself to a floor grate is contemplated by the present invention.

In one embodiment the invention considers a combination paint rack and floor grate assembly having at least a floor grate comprising a plurality of horizontal bars and a plurality of crossing bars oriented perpendicular to the horizontal bars forming rectangular slits, a paint rack, the paint rack having an attachment support bar, three leg portions, and three grate attachment portions, the three grate attachment portions matably attached to the floor grate, the three leg portions mounted on top of the three grate attachment portions and extending upwardly from the floor grate, the attachment support bar oriented generally perpendicular to the floor grate and connected to the three leg portions, and extending upwardly from the three leg portions, and a paint stand attachment removably connected to the paint rack on the attachment support bar.

In one embodiment the three grate attachment portions have horizontal slits located near the bottom of the three leg portions capable of being matably mounted to the plurality of bars or the plurality of crossing bars of the grate, the horizontal slits being aligned in a plane parallel to the grate and the slits opening on the same end so they can be simultaneously slid onto the grate, and wherein the three leg portions have two mirrored front leg portions and a third back leg portion oriented from the front leg portions in the direction of the openings of the slits, the back leg portion having a locking pinhole matable with a locking pin, the locking pin being capable of being inserted into the locking pinhole in a downward direction securing the back leg portion to the grate by forming a closed loop.

In another embodiment a swinging bar is located between two of the three leg portions the swinging bar being rotatably connected to each of the two leg portions, and a locking foot pedal, the locking foot pedal having a hooking portion matable to the grate and a pedal portion, wherein the locking foot pedal swings from a first unlocked position down to a second locked position when a downward force is applied to the pedal portion, thereby securing the paint rack to the grate by a friction lock. In certain embodiments the three leg portions have two mirrored front leg portions and a third back leg portion, the swinging bar is located between the two mirrored front leg portions, the grate attachment portions attached to the two front leg portions have downward facing U-shaped brackets capable of being matably mounted to the plurality of bars or the plurality of crossing bars of the grate, and the grate attachment portion attached to the third back leg portion comprises a horizontal C-shaped bracket aligned in a plane parallel to the grate and the opening of the C-shaped bracket oriented inwards towards the swinging bar and capable of being slid onto the grate. In some preferred embodiments, the grate attachment portions are detachable from the leg portions and are secured to the leg portions using nut and bolt attachments.

In certain preferred embodiments, the paint stand attachment is removably connected to the paint rack by a nob and screw locking mechanism.

In another embodiment, the invention contemplates a paint rack having at least an attachment support bar, three leg portions, and three grate attachment portions, the three grate attachment portions matably attachable to a floor grate, the three leg portions mounted on top of the three grate attachment portions and extending upwardly from the grate attachment portions, the attachment support bar connected to the three leg portions, and extending upwardly from the three leg portions.

In certain embodiments, the paint rack has the three grate attachment portions having horizontal slits located near the bottom of the three leg portions capable of being matably mounted to the floor grate, the horizontal slits being aligned in a plane parallel to the grate and the slits opening on the same end so they can be simultaneously slid onto the grate, wherein the three leg portions comprise two mirrored front leg portions and a third back leg portion oriented from the front leg portions in the direction of the openings of the slits, the back leg portion having a locking pinhole matable with a locking pin, the locking pin being capable of being inserted into the locking pinhole in a downward direction securing the back leg portion to the grate by forming a closed loop. Some embodiments contemplate the back leg portion having a sleeve aligned with the locking pinhole capable of receiving the locking pin therein.

In certain other embodiments the paint rack has a swinging bar located between two of the three leg portions the swinging bar being rotatably connected to each of the two leg portions, and a locking foot pedal, the locking foot pedal having a hooking portion matable to the grate and a pedal portion, wherein the locking foot pedal swings from a first unlocked position down to a second locked position when a downward force is applied to the pedal portion, thereby securing the paint rack to the grate by a friction lock. Such embodiments may also have the three leg portions comprise two mirrored front leg portions and a third back leg portion, the swinging bar is located between the two mirrored front leg portions, the grate attachment portions attached to the two front leg portions comprise downward facing U-shaped brackets capable of being matably mounted to the plurality of bars or the plurality of crossing bars of the grate, and the grate attachment portion attached to the third back leg portion comprises a horizontal C-shaped bracket aligned in a plane parallel to the grate and the opening of the C-shaped bracket oriented inwards towards the swinging bar and capable of being slid onto the grate. In certain embodiments, the grate attachment portions are detachable from the leg portions and are secured to the leg portions using nut and bolt attachments.

In another embodiment, the invention considers a method of painting in a downdraft paint booth having at least the steps of: providing a paint spray apparatus and a paintable object, providing a paint rack, an attachment support bar, three leg portions, and three grate attachment portions, the three grate attachment portions matably attachable to a floor grate, the three leg portions mounted on top of the three grate attachment portions and extending upwardly from the grate attachment portions, the attachment support bar connected to the three leg portions, and extending upwardly from the three leg portions, mating the paint rack to the floor grate and securing the paint rack in place, providing a paint stand attachment and connecting the paint stand attachment to the attachment support bar, mounting the paintable object onto the paint stand attachment, and painting the paintable object.

The method above may preferably be modified to also have the paint rack comprise a swinging bar located between two of the three leg portions the swinging bar being rotatably connected to each of the two leg portions; a locking foot pedal, the locking foot pedal comprising a hooking portion matable to the grate and a pedal portion, the three leg portions comprise two mirrored front leg portions and a third back leg portion, the swinging bar is located between the two mirrored front leg portions, the grate attachment portions attached to the two front leg portions comprise downward facing U-shaped brackets capable of being matably mounted to the plurality of bars or the plurality of crossing bars of the grate; and the grate attachment portion attached to the third back leg portion comprises a horizontal C-shaped bracket aligned in a plane parallel to the grate and the opening of the C-shaped bracket oriented inwards towards the swinging bar. In some embodiments, mating the paint rack to the floor grate comprises: sliding the C-shaped bracked onto a bar of the grate, mounting the U-shaped brackets onto the grate, and swinging the locking foot pedal from a first unlocked position down to a second locked position by applying a downward force is to the pedal portion, and securing the paint rack to the grate by a friction lock.

Such embodiments do not represent the full scope of the invention. Reference is made therefore to the claims herein for interpreting the full scope of the invention. Other objects of the present invention, as well as particular features, elements, and advantages thereof, will be elucidated or become apparent from, the following description and the accompanying drawing figures.

BRIEF DESCRIPTION OF THE DRAWINGS

Other features of my invention will become more evident from a consideration of the following brief descriptions of drawings.

DETAILED DESCRIPTION OF THE PREFERRED EMBODIMENT

Referring now the drawings with more specificity, the present invention essentially provides an improved paint stand or paint rack that is particularly effective at coupling with a grate, typically a floor grate used in modern downdraft paint booths. Such coupling provides for stability while minimizing floor footprint.

Figure 1:
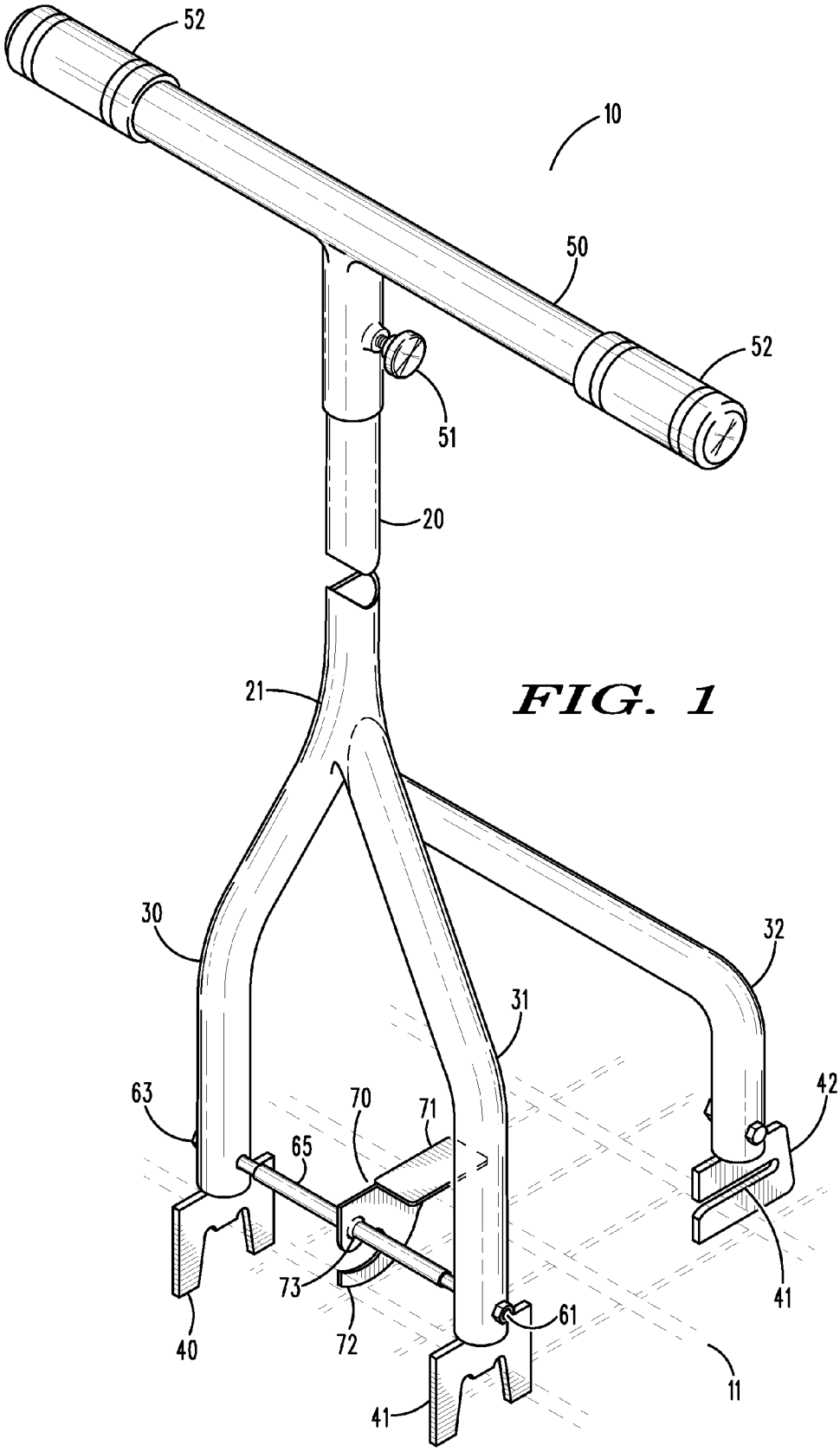
FIG. 1 is a perspective view of a preferred paint rack assembly coupled with a floor grate.

Looking now to FIG. 1, paint rack 10 is a preferred embodiment of a paint rack which may preferably be coupled to industrial grate 11. Paint rack 10 may preferably be fabricated out of steel, stainless steel, aluminum, and/or other analogous metallic alloys and may be comprised of solid bars or hollow tubes to increase strength or decrease weight depending on the needs of the user. Paint rack 10 according to the present invention, preferably comprises, an attachment support bar 20, three leg portions 30, 31, 32, and three grate attachment portions 40, 41, 42, and paint stand 50.

The attachment support bar 20 preferably comprises the main body of paint rack 10 and is preferably at least 12 inches in length, and 1 inch in diameter. However, in alternate embodiments it may be shorter or longer depending on the height of the user and size of the piece to be painted. In some embodiments it may be forked or branched to support additional or unconventionally shaped painted pieces.

Bar 20 is connected to legs 30, 31, 32 at or near branching point 21 located at the bottom of bar 20. The legs are preferably molded or welded to the attachment bar 20, but may also be operably connected to the bar using screws, bolts, or adjustable pressure points if the user desires flexibility over stability and permanence. In the present invention, front legs 30, 31 are mirrored and connect with grate attachments 40, 41 respectively. Grate attachments 40, 41 are, typically downward facing C, U, or W brackets that are adapted for connecting with a floor grate 11. In at least one embodiment attachments 40, 41 are 2¼" in length and ⅛" to ¼" in width so as to adapt to the most typical grates currently utilized in downdraft booths, however other sizes are contemplated to fit to other industrial grates. As shown with greater specificity in FIG. 2, attachments 40, 41 are preferably attached using a nut-and-bolt attachment method with nuts 60, 61, cooperatively mating with bolt 66 inside of sleeve 65. In certain embodiments, bolt 66 is capable of swinging freely, and in other embodiments it is tightened to immobility. Looking to back leg 32, it is preferably offset the mirrored front legs and provided with a forwards facing C-shaped attachment 42. Attachment 42 is preferably attached using nut 63 and bolt 62, but in certain embodiments it is contemplated that the attachment 42 is welded to leg 42 to create a permanently affixed attachment point. Typically, slit 43 is greater than one inch in depth and attachment 42 is /8" to ¼" in width so as to adapt to the most typical grates currently utilized in downdraft booths.

Operably connected to bolt 66 is foot pedal 70. Foot pedal 70 may swing freely on bolt 66, may swing be attached or welded to sleeve 65, may be welded to bolt 66, or may be tightly mounted to bolt 66 so as to only rotate when a significant force, such as a kick or step is applied. Foot pedal 70 comprises, at least, pedal 71, hook 72, and attachment point 73. In operation, a user may place his or her foot onto pedal 71 and apply a downward force, thus swinging foot pedal 70 around attachment point 73 and operably securing hook 72 around a portion of grate 11. This operation secures paint rack 10 in place onto grate 11. To remove the rack 10, a user simply may exert an upward force onto pedal 71 and the apparatus will be released from grate 11.

Figure 2:
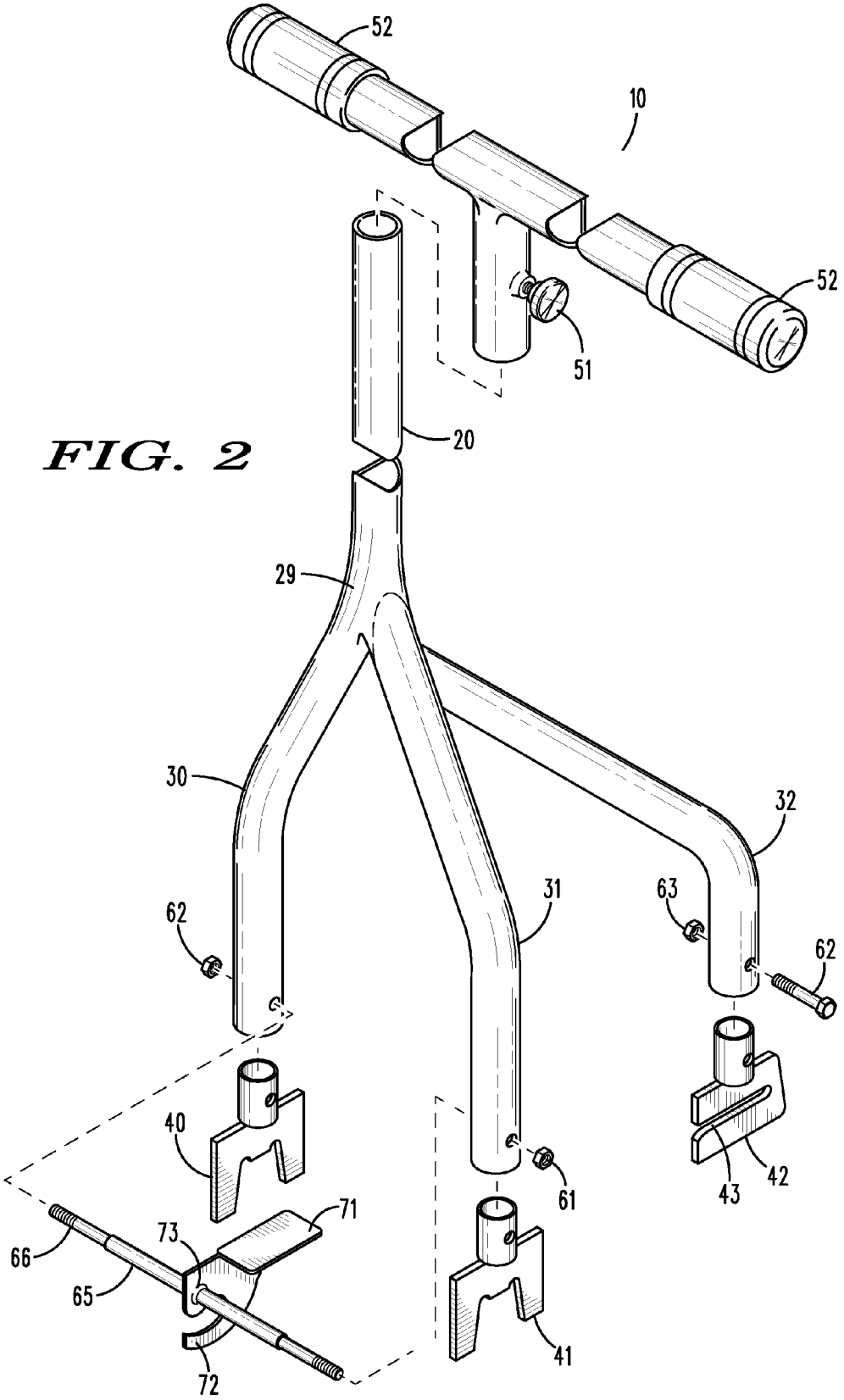
FIG. 2 is an exploded view of the preferred paint rack of FIG. 1.

Attached to or near the top of bar 20 is paint stand 50, in both FIGS. 1, 2 a representative paint stand is shown. Paint stand 50 is preferably mounted to support bar 20, preferably using adjustable button screw 51 for simple replacement of the paint stand attachments. A representative paint stand as at 50 may also preferably have padding 52 to prevent damage to the automotive or other parts being painted. While only one, representative paint stand or attachment 50 is shown, it is contemplated that several, alternative paint stands of varying shapes may be utilized and cooperatively adapted to fit with paint rack 10 in order to accommodate the many types of automotive parts that are likely to be seen in a paint shop.

Figure 3:
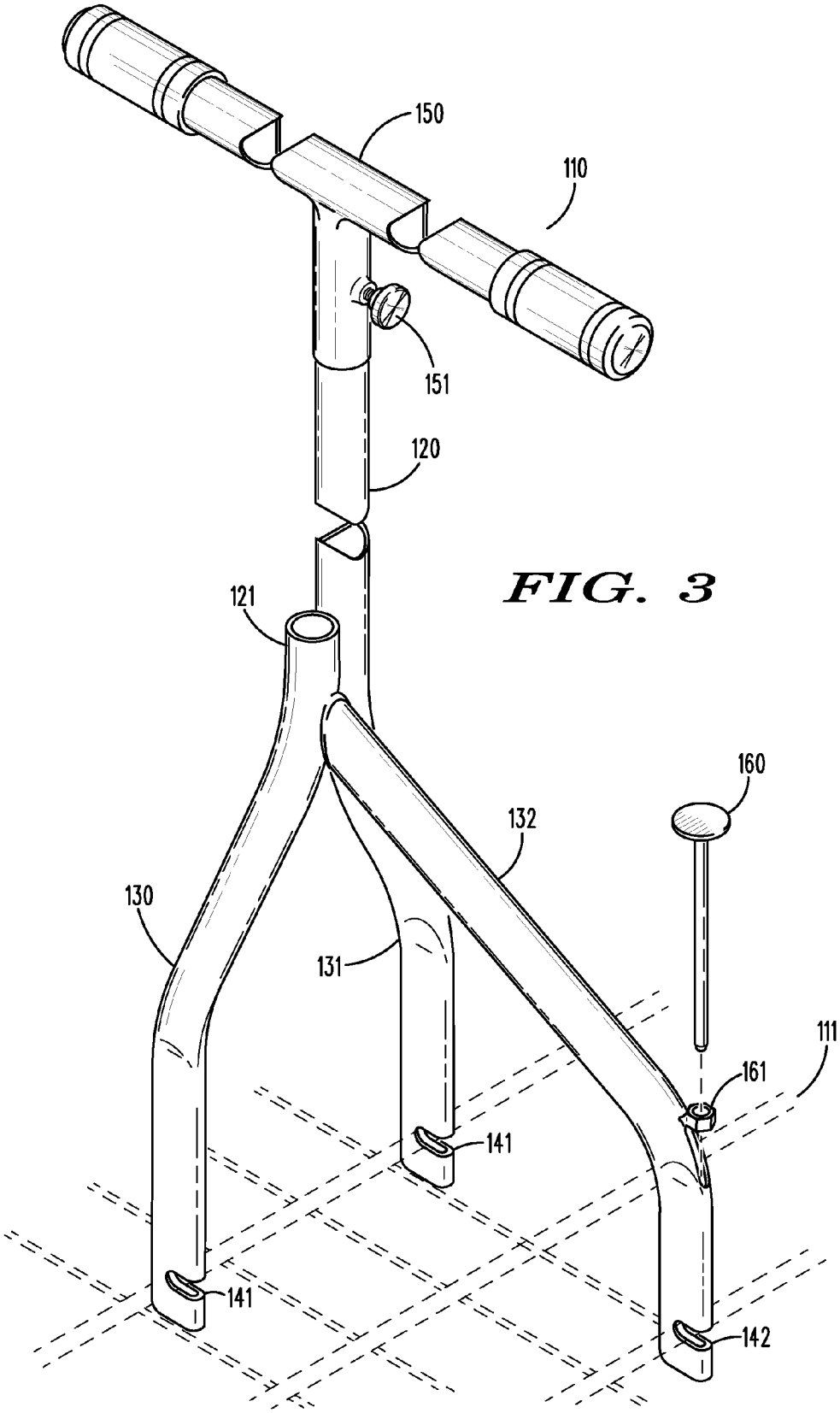
FIG. 3 is a perspective view of another embodiment of a paint rack assembly coupled to a floor grate.

Looking now to FIG. 3, paint rack 110 is a preferred embodiment of a paint rack which may preferably be coupled to industrial grate 111. Paint rack 110 may preferably be fabricated out of steel, stainless steel, aluminum, and/or other analogous metallic alloys and may be comprised of solid bars or hollow tubes to increase strength or decrease weight depending on the needs of the user. Paint rack 110 according to the present invention, preferably comprises, an attachment support bar 120, three leg portions 130, 131, 132, and three grate attachment portions 140, 141, 142, and paint stand 150.

Figure 4A:
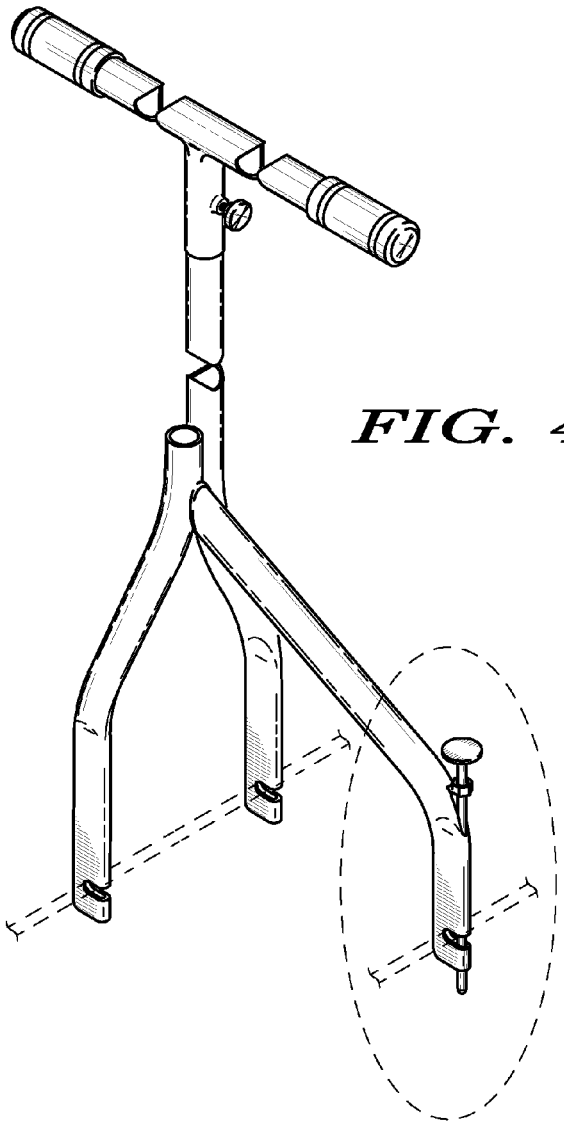
FIG. 4*a* is a perspective view of the paint rack assembly of FIG. 3 in a locked position.
Figure 4B:
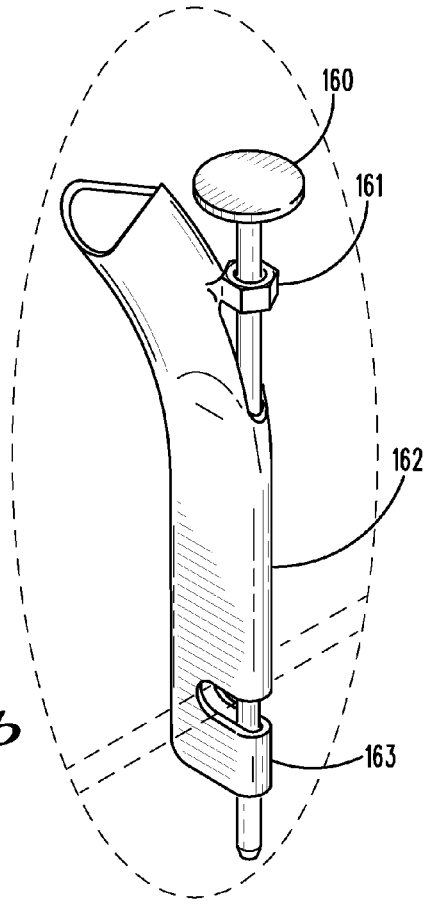
FIG. 4*b* is a close up perspective view of the locking mechanism of the paint rack assembly of FIG. 3.

Bar 120 is connected to legs 130, 131, 132 at or near branching point 121 located at the bottom of bar 120. The legs are preferably molded or welded to the attachment bar 120, but may also be operably connected to the bar using screws, bolts, or adjustable pressure points if the user desires flexibility over stability and permanence. In the present invention, front legs 130, 131 are mirrored and comprise near the bottom portions with grate attachment points 140, 141 respectively. Grate attachment points 140, 141 are, typically slits preferably at least one inch deep for connecting with a floor grate 111. The depth and width of these slits can be modified so as to adapt to the most typical grates currently utilized in downdraft booths, and can be easily adapted if booths are changed in the marketplace. Looking at back leg 132, it is preferably offset the mirrored front legs and provided with an attachment point 142 similar in construction to attachment points 140, 140. However, attachment 142 is shown with greater specificity in FIGS. 4*a*, 4*b*. Attachment point 142 is cooperable with pin 160 which provides stability by locking the paint rack 110 to grate 111. Specifically, pin 160 locks into locking pinhole 161 which may preferably have a snap or snapping joints to selectively secure the pin. Then, pin 160 passes through sleeve 162 and into sleeve 163 thereby locking the rack into place by surrounding a portion of the grate as shown in FIG. 4*b*.

Attached to or near the top of bar 120 is paint stand 150, in both FIGS. 3, 4 a representative paint stand is shown. Paint stand 150 is preferably mounted to support bar 120, preferably using adjustable button screw 151 for simple replacement of the paint stand attachments. A representative paint stand as at 150 may also preferably have padding 152 to prevent damage to the automotive or other parts being painted. While only one, representative paint stand or attachment 150 is shown, it is contemplated that several, alternative paint stands of varying shapes may be utilized and cooperatively adapted to fit with paint rack 110 in order to accommodate the many types of automotive parts that are likely to be seen in a paint shop.

Figures 5A, 5B:
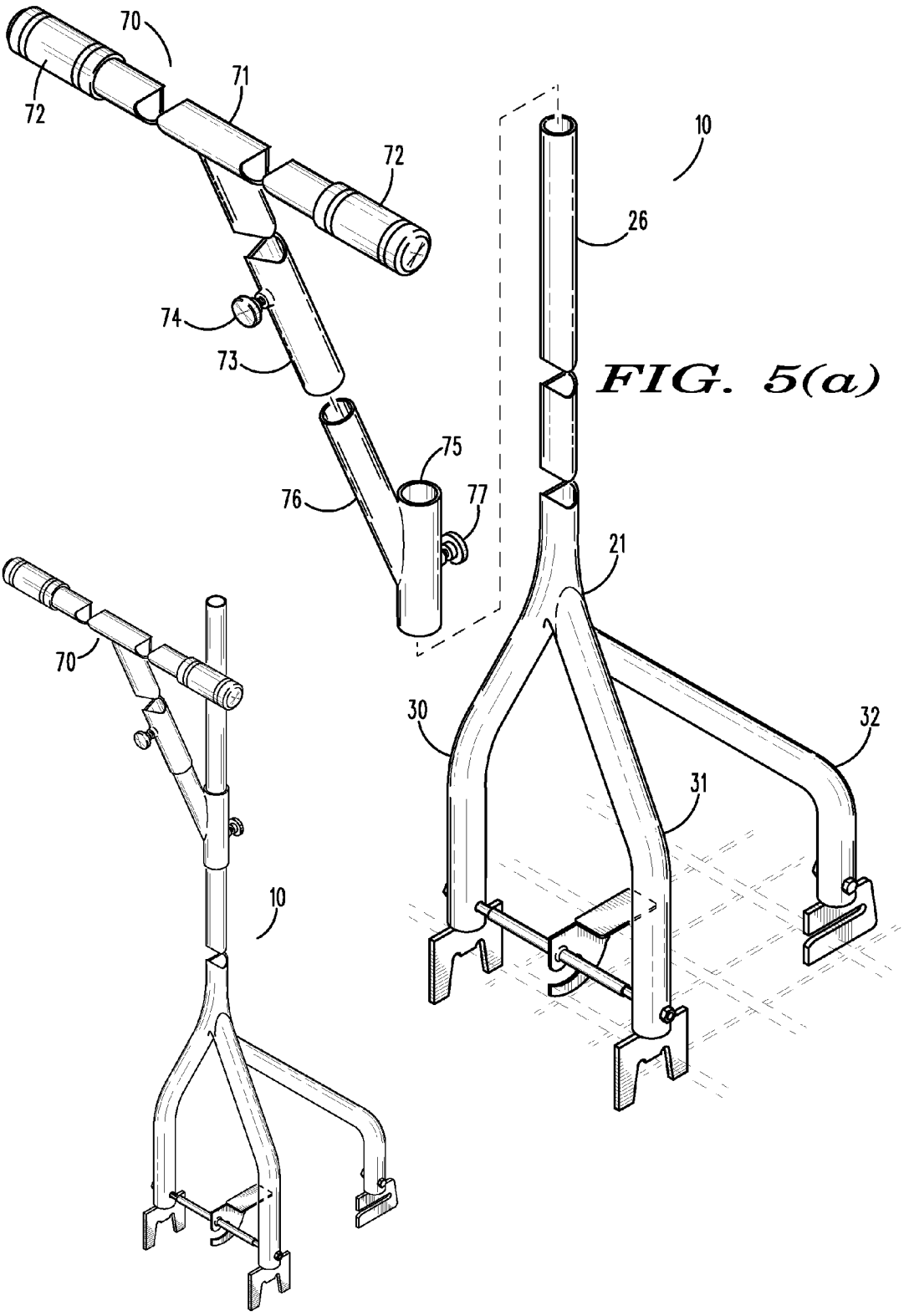
FIG. 5*a* is a perspective view of the paint rack assembly of FIG. 1 in a locked position in combination with a Y-attachment.
FIG. 5*b* is a perspective view of the combination of FIG. 5*a* with the Y-attachment mounted.

Looking now to FIG. 5, an embodiment of the invention is shown. This device is generally equivalent to the embodiments of FIGS. 1, 2. In such an embodiment support bar 20 may have extended end 26 that is matably cooperable with Y-attachment or Y-bar 70. Y-attachment 70 is preferably mounted to support bar 20 or extended sleeve 26 using Y-bar sleeve 75. Preferably Y-attachment sleeve 75 has using adjustable button screw 77 for simple removal, or for adjusting the height of the Y-attachment. Angled bar 76 preferably extend at an angle from sleeve 75, the angle preferably being between 20 and 50 degrees from vertical. A representative Y-attachment as at 70 may also preferably comprise a crossbar 71 and padding 72 to prevent damage to the automotive or other parts being painted. In certain embodiments, crossbar 71 is attached to tube 73 which is mountable at angled bar 76 and may preferably be tightened using adjustable button screw 74. In certain embodiments the top section of the Y-attachment is not removable and adjustable as shown, but rather bar 76 and sleeve 73 form a single bar, or may preferably be permanently secured together such as by welding.

Accordingly, although the invention has been described by reference to certain preferred and alternative embodiments, it is not intended that the novel arrangements be limited thereby, but that modifications thereof are intended to be included as falling within the broad scope and spirit of the foregoing disclosures and the appended drawings.

I claim:

1. A combination paint rack and floor grate assembly comprising:

a floor grate comprising a plurality of horizontal bars and a plurality of crossing bars oriented perpendicular to the horizontal bars forming rectangular slits;

a paint rack;

the paint rack comprising an attachment support bar, three leg portions, and three grate attachment portions, the three grate attachment portions matably attached to the floor grate, the three leg portions mounted on top of the three grate attachment portions and extending upwardly from the floor grate, the attachment support bar oriented generally perpendicular to the floor grate and connected to the three leg portions, and extending upwardly from the three leg portions; and a paint stand attachment removably connected to the paint rack on the attachment support bar.

2. The combination of claim 1 wherein:

the three grate attachment portions comprise horizontal slits located near the bottom of the three leg portions capable of being matably mounted to the plurality of bars or the plurality of crossing bars of the grate, the horizontal slits being aligned in a plane parallel to the grate and the slits opening on the same end so they can be simultaneously slid onto the grate; and wherein the three leg portions comprise two mirrored front leg portions and a third back leg portion oriented from the front leg portions in the direction of the openings of the slits, the back leg portion having a locking pinhole matable with a locking pin, the locking pin being capable of being inserted into the locking pinhole in a downward direction securing the back leg portion to the grate by forming a closed loop.

3. The combination of claim 1 further comprising:

a swinging bar located between two of the three leg portions the swinging bar being rotatably connected to each of the two 5 leg portions; and a locking foot pedal, the locking foot pedal comprising a hooking portion matable to the grate and a pedal portion, wherein the locking foot pedal swings from a first unlocked position down to a second locked position when a downward force is applied to the pedal portion, thereby securing the paint rack to the grate by a friction lock.

4. The combination of claim 3 wherein:

the three leg portions comprise two mirrored front leg portions and a third back leg portion;

the swinging bar is located between the two mirrored front leg portions;

the grate attachment portions attached to the two front leg portions comprise downward facing U-shaped brackets capable of being matably mounted to the plurality of bars or the plurality of crossing bars of the grate; and the grate attachment portion attached to the third back leg portion comprises a horizontal C-shaped bracket aligned in a plane parallel to the grate and the opening of the C shaped bracket oriented inwards towards the swinging bar and capable of being slid onto the grate.

5. The combination of claim 4 wherein:

the grate attachment portions are detachable from the leg portions and are secured to the leg portions using nut and bolt attachments.

6. The combination of claim 1 wherein:

the paint stand attachment is removably connected to the paint rack by a nob and screw locking mechanism.

7. The combination of claim 1 further comprising:

a second attachment support bar oriented generally at an angle from 5 the attachment support bar; and a second paint stand attachment removably connected to the paint rack on the second attachment support bar.

8. A paint rack comprising:

an attachment support bar, three leg portions, and three grate attachment portions, the three grate attachment portions matably attachable to a floor grate, the three leg portions mounted on top of the three grate attachment portions and extending upwardly from the grate attachment portions, the attachment support bar connected to the three leg portions, and extending upwardly from the three leg portions;

wherein the three grate attachment portions comprise horizontal slits located near the bottom of the three leg portions capable of being matably mounted to the floor grate, the horizontal slits being aligned in a plane parallel to the grate and the slits opening on the same end so they can be simultaneously slid onto the grate; and wherein the three leg portions comprise two mirrored front leg portions and a third back leg portion oriented from the front leg portions in the direction of the openings of the slits, the back leg portion having a locking pinhole matable with a locking pin, the locking pin being capable of being inserted into the locking pinhole in a downward direction securing the back leg portion to the grate by forming a closed loop.

9. The paint rack of claim 8 wherein:

the back leg portion comprises a sleeve aligned with the locking pinhole capable of receiving the locking pin therein.

10. The paint rack of claim 8 further comprising:

a swinging bar located between two of the three leg portions the swinging bar being rotatably connected to each of the two leg portions; and a locking foot pedal, the locking foot pedal comprising a hooking portion matable to the grate and a pedal portion, wherein the locking foot pedal swings from a first unlocked position down to a second locked position when a downward force is applied to the pedal portion, thereby securing the paint rack to the grate by a friction lock.

11. The paint rack of claim 10 wherein:

the three leg portions comprise two mirrored front leg portions and a third back leg portion;

the swinging bar is located between the two mirrored front leg portions;

the grate attachment portions attached to the two front leg portions comprise downward facing U-shaped brackets capable of being matably mounted to the plurality of bars or the plurality of crossing bars of the grate; and the grate attachment portion attached to the third back leg portion comprises a horizontal C-shaped bracket aligned in a plane parallel to the grate and the opening of the C-shaped bracket oriented inwards towards the swinging bar and capable of being slid onto the grate.

12. The paint rack of claim 11 wherein:

the grate attachment portions are detachable from the leg portions and are secured to the leg portions using nut and bolt attachments.

13. The paint rack of claim 8 wherein:

the paint stand attachment is removably connected to the paint 5 rack by a nob and screw locking mechanism.

14. The paint rack of claim 8 further comprising:

a second attachment support bar oriented generally at an angle from the attachment support bar; and a second paint stand attachment removably connected to the paint rack on the second attachment support bar.

* * * * *